US011056269B2

(12) United States Patent
Maruyama et al.

(10) Patent No.: US 11,056,269 B2
(45) Date of Patent: Jul. 6, 2021

(54) COIL COMPONENT AND METHOD FOR MANUFACTURING COIL COMPONENT

(71) Applicant: TAIYO YUDEN CO., LTD., Tokyo (JP)

(72) Inventors: Yoshikazu Maruyama, Takasaki (JP); Noriyuki Mabuchi, Takasaki (JP); Ichiro Yokoyama, Takasaki (JP); Masataka Kohara, Hidaka-gun (JP); Keiichi Nozawa, Hidaka-gun (JP); Masakazu Okazaki, Hidaka-gun (JP); Hideaki Hoshino, Hidaka-gun (JP); Tomoyuki Oyoshi, Hidaka-gun (JP); Takehumi Yamada, Hidaka-gun (JP); Chikako Yoshida, Hidaka-gun (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 279 days.

(21) Appl. No.: 16/049,386

(22) Filed: Jul. 30, 2018

(65) Prior Publication Data

US 2019/0043656 A1 Feb. 7, 2019

(30) Foreign Application Priority Data

Aug. 3, 2017 (JP) ..... JP2017-151109

(51) Int. Cl.
*H01F 27/28* (2006.01)
*H01F 41/04* (2006.01)
(Continued)

(52) U.S. Cl.
CPC ..... *H01F 27/2804* (2013.01); *H01F 17/0013* (2013.01); *H01F 27/323* (2013.01);
(Continued)

(58) Field of Classification Search
CPC ..... H01F 27/2804
See application file for complete search history.

(56) References Cited

U.S. PATENT DOCUMENTS 4,728,390 A * 3/1988 Yamamoto ..... H01F 5/003 216/105
5,821,846 A * 10/1998 Leigh ..... H01F 17/0006 336/200

(Continued)

FOREIGN PATENT DOCUMENTS

JP 2003257740 A 9/2003
JP 2013098356 A 5/2013

*Primary Examiner* — Elvin G Enad
*Assistant Examiner* — Malcolm Barnes
(74) *Attorney, Agent, or Firm* — Law Office of Katsuhiro Arai

(57) ABSTRACT

In an embodiments, a coil component includes: an element body part 10 and a coil 30 of spiral shape constituted by multiple winding conductors 32 and through hole conductors 34 that interconnect the winding conductors 32; wherein each winding conductor 32 has, in a cross-sectional view in the width direction of the winding conductor 32, a flat side 40 that extends in a second direction substantially perpendicular to the coil axis of the coil 30; and the point of intersection 48 between a figure line 42 corresponding to the longest part in a first direction, and a figure line 44 corresponding to the longest part in the second direction, with respect to the coil axis, is positioned on the figure line 42 within one-quarter of the figure line away from one end 50 on the side 40 or from the other end 52 opposing the side 40.

9 Claims, 11 Drawing Sheets

(51) Int. Cl.
*H01F 27/32* (2006.01)
*H01F 41/12* (2006.01)
*H01F 17/00* (2006.01)

(52) U.S. Cl.
CPC ..... *H01F 41/043* (2013.01); *H01F 41/122* (2013.01); *H01F 2027/2809* (2013.01)

(56) References Cited

U.S. PATENT DOCUMENTS

| | | | | |
|---|---|---|---|---|
| 2014/0292468 | A1* | 10/2014 | Motomiya | H05K 3/1291 336/200 |
| 2017/0186528 | A1* | 6/2017 | Otsubo | H01F 41/041 |
| 2017/0372834 | A1* | 12/2017 | Kawada | H01F 30/10 |
| 2018/0033549 | A1* | 2/2018 | Taniguchi | H01F 17/0013 |
| 2018/0090266 | A1* | 3/2018 | Sano | H01F 41/122 |
| 2019/0013133 | A1* | 1/2019 | Sasaki | H01F 27/2804 |

* cited by examiner

COIL COMPONENT AND METHOD FOR MANUFACTURING COIL COMPONENT

BACKGROUND

Field of the Invention

The present invention relates to a coil component and a method for manufacturing coil component.

Description of the Related Art

Coil components constituted by a coil provided inside an element body part made of an insulative body, are known. For example, coil components are known whose coil conductor has a roughly circular cross-sectional shape for improved Q-value (refer to Patent Literature 1, for example). Also known are coil components whose coil conductor has a cross-sectional shape with rounded edges, and also has a ratio of T/W, where T and W stand for the thickness and width of the coil conductor, respectively, of 0.23 to 0.45, and an edge angle of 40° to 70° to improve the Q-value (refer to Patent Literature 2, for example).

BACKGROUND ART LITERATURES

[Patent Literature 1] Japanese Patent Laid-open No. 2003-257740

[Patent Literature 2] Japanese Patent Laid-open No. 2013-98356

SUMMARY

However, conventional coil components still have room for improvement in terms of their Q-value. The present invention was made in light of the aforementioned problem, and its object is to improve the Q-value.

Any discussion of problems and solutions involved in the related art has been included in this disclosure solely for the purposes of providing a context for the present invention, and should not be taken as an admission that any or all of the discussion were known at the time the invention was made.

The present invention is a coil component, comprising: an element body part made of an insulative body; and a coil of spiral shape provided inside the element body part and encompassing multiple winding conductors and through hole conductors that interconnect the multiple winding conductors; wherein the multiple winding conductors are such that: each has, in a cross-sectional view in the width direction of the winding conductor, a side that extends straight in the direction crossing substantially at right angles with the coil axis of the coil (or in the direction substantially perpendicular to the coil axis of the coil wherein "substantially" refers to "for the most part," "essentially," or "to an extent of an immaterial difference or a difference recognized by a skilled artisan in the art" such as those of less than a deviation of 10%, 5%, 1%, or less, depending on the embodiment); and the point of intersection between a first line segment (also referred to as "first figure line") corresponding to the longest part in the direction of the coil axis, and a second line segment (also referred to as "second figure line") corresponding to the longest part in the direction crossing substantially at right angles with the coil axis ("substantially" refers to the same as above), is positioned on the first line segment within one-quarter of the first line segment away from one end on the aforementioned side or from the other end opposing the side.

The aforementioned constitution may be such that the ratio of the length of the side relative to the length of the second line segment is equal to or greater than 4/5.

The aforementioned constitution may be such that, in all of the multiple winding conductors, the point of intersection is positioned on the first line segment within one-quarter of the first line segment away from the one end.

The aforementioned constitution may be such that, in all of the multiple winding conductors, the point of intersection is positioned on the first line segment within one-quarter of the first line segment away from the other end.

The aforementioned constitution may be such that, when the position of the point of intersection is converted to a numeric value based on the one end and the other end of the first line segment representing 0 and 100, respectively, the difference between the maximum value of the point of intersection, and the minimum value of the point of intersection, among the multiple winding conductors, is equal to or smaller than 10.

The aforementioned constitution may be such that the length of the first line segment is equal to or greater than ½ times the length of the second line segment.

The aforementioned constitution may be such that the multiple winding conductors each have, in the cross-sectional view, a roughly polygonal shape, roughly semi-circular shape, or roughly semi-elliptical shape.

The present invention is a method for manufacturing coil component, comprising: a step to form, in multiple insulation sheets, winding conductors and through hole conductors that will constitute a coil; a step to apply, on the multiple insulation sheets, multiple insulation pastes that will cover the side faces of the winding conductors; and a step to stack and pressure-bond together the multiple insulation sheets to which the multiple insulation pastes have been applied.

According to the present invention, the Q-value can be improved.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 2A is an exploded plan view of the coil component pertaining to the example, while

FIG. 3A is a view of cross-section A-A in FIG. 2B, while

DESCRIPTION OF THE SYMBOLS

Figure 1:
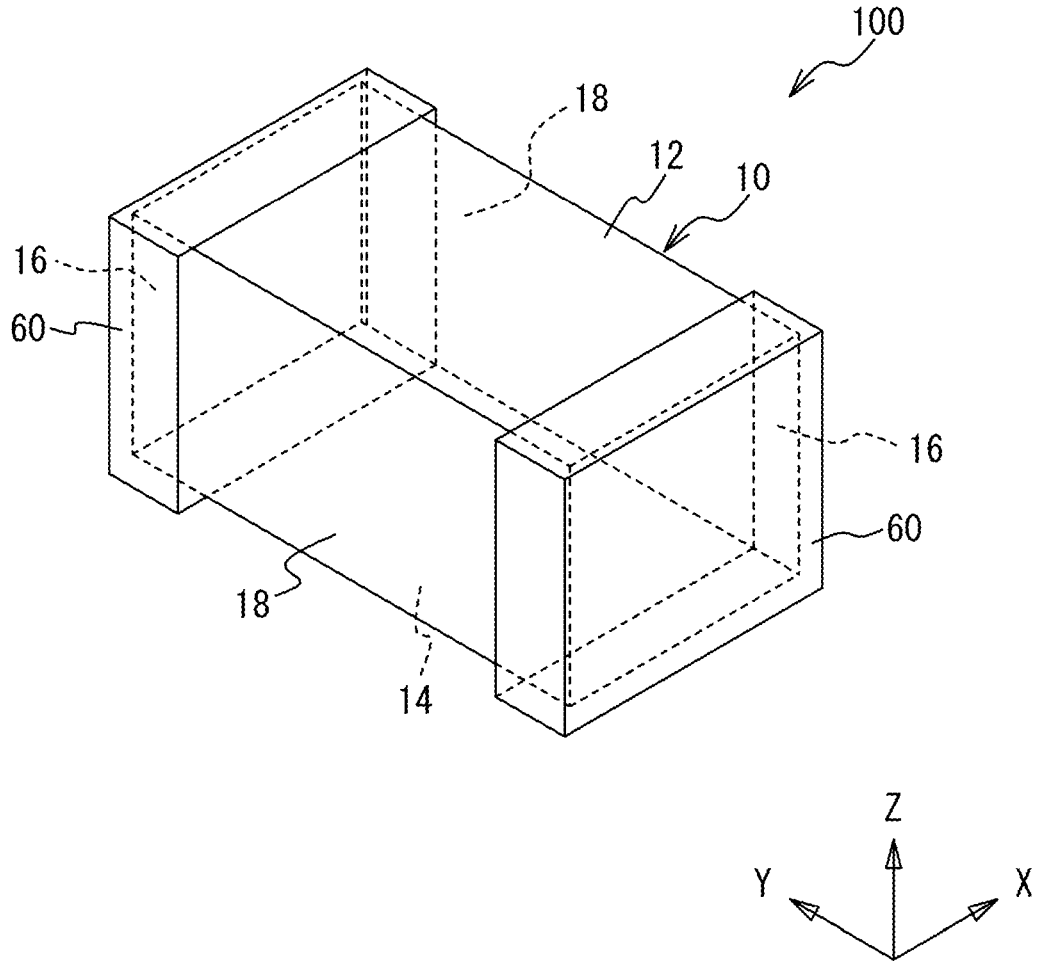
FIG. 1 is a perspective view of the coil component pertaining to an example.

10 Element body part
12 Top face
14 Bottom face
16 End face
18 Side face
20 Insulation layer
20*a* Green sheet
20*b*, 20*c* Insulation paste
30 Coil
32 Winding conductor
34 Through hole conductor
36 Land
38 Lead conductor
40 Side
42 Line segment
44 Line segment
48 Point of intersection
50 One end
52 Other end
60 External electrode
70 Film
72 Blade
74 Laser machine
75 Laser beam
76 Through hole
100 Coil component

DETAILED DESCRIPTION OF EMBODIMENTS

An example of the present invention is explained below by referring to the drawings.

Example

FIG. 1 is a perspective view of the coil component pertaining to the example. As shown in FIG. 1, a coil component 100 in the example includes an element body part 10 made of an insulative body, and external electrodes 60 provided on the surface of the element body part 10. The element body part 10 is shaped as a rectangular solid having a top face 12, a bottom face 14, a pair of end faces 16, and a pair of side faces 18, as well as a width-direction side extending in the X-axis direction, a length-direction side extending in the Y-axis direction, and a height-direction side extending in the Z-axis direction. The bottom face 14 is a mounting face, while the top face 12 is a face opposing the bottom face 14. The end faces 16 are faces connected to the pair of short sides, while the side faces 18 are faces connected to the pair of long sides, of the top face 12 and bottom face 14. It should be noted that the element body part 10 is not limited to one having a perfect rectangular solid shape; instead, it may have a roughly rectangular solid shape with rounded apexes, rounded ridges (boundaries between the faces), or curved faces, or the like.

The element body part 10 is formed by an insulation material whose primary component is glass or resin, or by a magnetic material such as ferrite. The element body part 10 has a width dimension of 0.05 mm to 0.3 mm, a length dimension of 0.1 mm to 0.6 mm, and a height dimension of 0.05 mm to 0.5 mm, for example.

The external electrodes 60 are external terminals used for surface mounting, and two of these are provided in a manner opposing each other in the Y-axis direction. The external electrodes 60 are provided in such a way that they extend from the bottom face 14, to the top face 12, via the end faces 16 and side faces 18, of the element body part 10. In other words, the external electrodes 60 are pentahedral electrodes extending to the five faces of the element body part 10. It should be noted that the external electrodes 60 may be trihedral electrodes extending from the bottom face 14, to the top face 12, via the end faces 16, of the element body part 10, or they may be dihedral electrodes extending from the bottom face 14, to the end faces 16, of the element body part 10.

The external electrodes 60 each includes a first metal layer provided on the surface of the element body part 10, a second metal layer covering the first metal layer, and a third metal layer covering the second metal layer. The first metal layer, second metal layer, and third metal layer are formed by applying a paste, plating, sputtering, or other method used in the thin-film forming processes. The first metal layer is formed by copper, aluminum, nickel, silver, platinum, palladium, or other metal material, or an alloy metal material containing the foregoing, for example. The second metal layer is a layer for reducing the diffusion of the first metal layer into, for example, a solder that has been bonded on the surface of the third metal layer, and it is a nickel plating layer, for instance. The third metal layer is formed by a metal exhibiting good solder wettability, for example, and it is a tin plating layer, for instance.

Figure 2A:
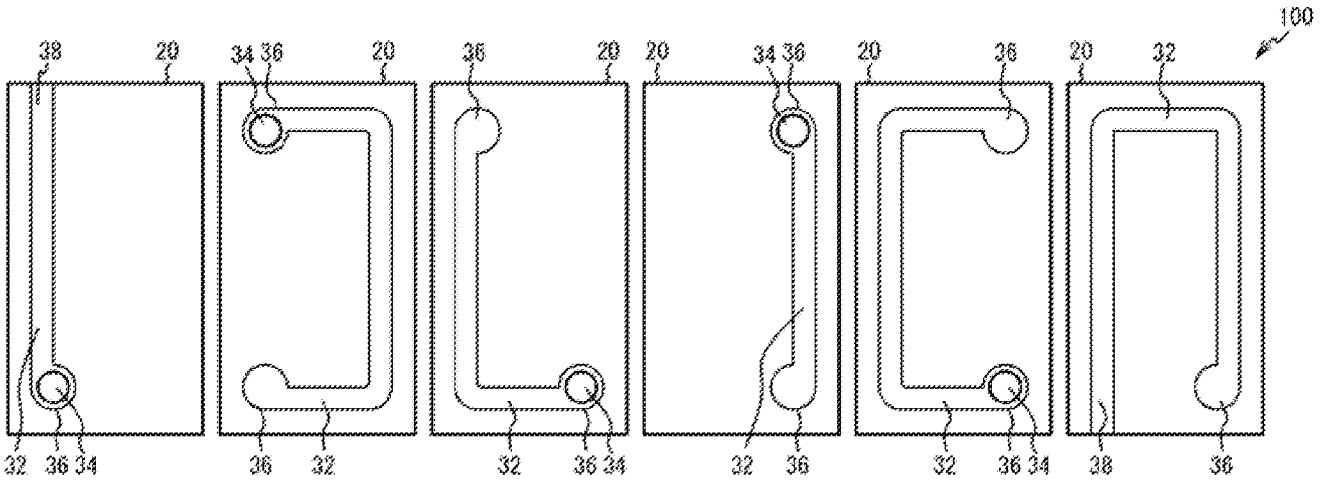
Figure 2B:
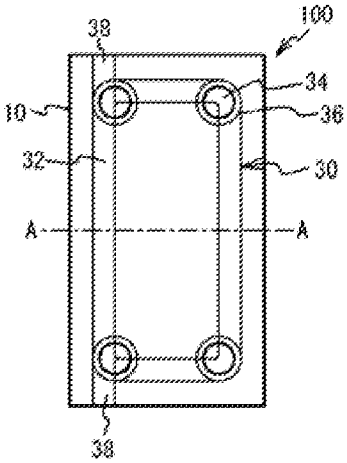
FIG. 2B is a perspective plan view showing the inside of the coil component pertaining to the example.

FIG. 2A is an exploded plan view of the coil component pertaining to the example, while FIG. 2B is a perspective plan view showing the inside of the coil component pertaining to the example. As shown in FIGS. 2A and 2B, the coil component 100 in the example has its element body part 10 formed by stacking multiple insulation layers 20 in which winding conductors 32 and through hole conductors 34 have been provided. The winding conductors 32 provided in each pair of adjoining insulation layers 20 among the multiple insulation layers 20, are connected by the through hole conductors 34 that are in contact with lands 36 constituting a part of the winding conductors 32 and are also penetrating the insulation layers 20 in the thickness direction. Accordingly, the winding conductors 32 extend spirally via the through hole conductors 34, and a coil 30 is formed in the element body part 10 as a result. The coil 30 has prescribed turn units, as well as a coil axis crossing roughly at right angles with the plane specified by the turn units.

The coil 30, in a plan view in the stacking direction of the multiple insulation layers 20, has a roughly rectangular, annular shape constituted by the winding conductors 32 which are provided in the multiple insulation layers 20 stacked on top of each other. The lands 36 are placed in the corners of the coil 30 of roughly rectangular, annular shape. The winding conductors 32 and through hole conductors 34 (i.e., the coil 30) are formed by copper, aluminum, nickel, silver, platinum, palladium, or other metal material, or an alloy metal material containing the foregoing, for example. Also, the coil 30 is electrically connected to the external electrodes 60 (refer to FIG. 1) provided on the surface of the element body part 10, via lead conductors 38. The lead conductors 38 are formed by the same metal material used for the winding conductors 32 and through hole conductors 34, for example.

Figure 3A:
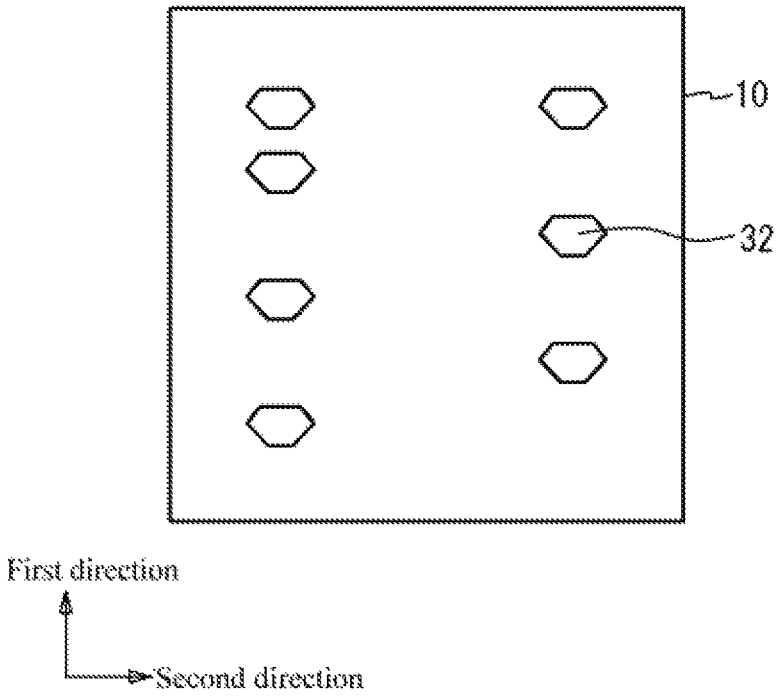
Figure 3B:
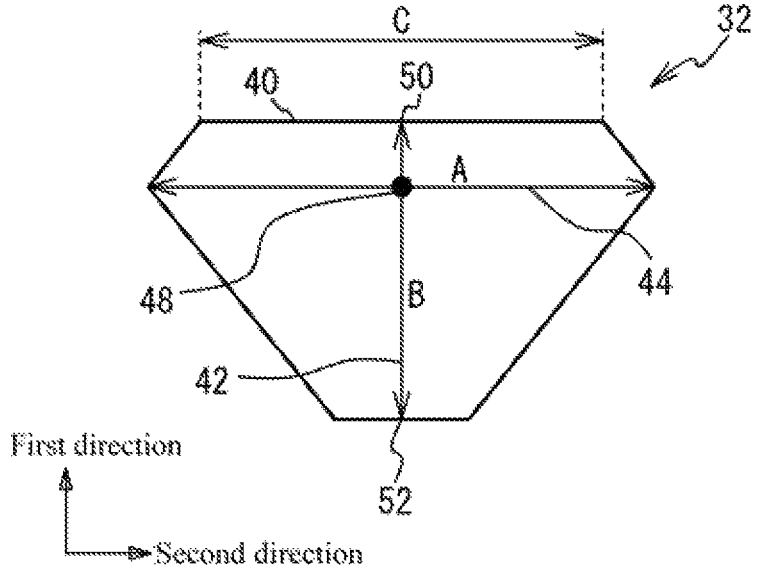
FIG. 3B is an enlarged view of a winding conductor in FIG. 3A.

FIG. 3A is a view of cross-section A-A in FIG. 2B, while FIG. 3B is an enlarged view of a winding conductor in FIG. 3A. As shown in FIGS. 3A and 3B, the winding conductors 32 each have, in a cross-sectional view in the width direction of the winding conductor 32, a roughly polygonal shape which has a side 40 that extends straight in a second direction crossing at right angles with a first direction corresponding to the direction of the coil axis. It should be noted that a "roughly polygonal shape" includes a shape with rounded apexes or rounded sides, among others.

The winding conductor 32 is such that the point of intersection 48 between the line segment 42 corresponding to the longest part in the first direction, and the line segment 44 corresponding to the longest part in the second direction, is positioned within one-quarter of the line segment away from one end 50, on the side 40, of the line segment 42. Also, the ratio (C/A) of the length C of the side 40 relative to the length A of the line segment 44 is equal to or greater than 4/5.

Figure 4:
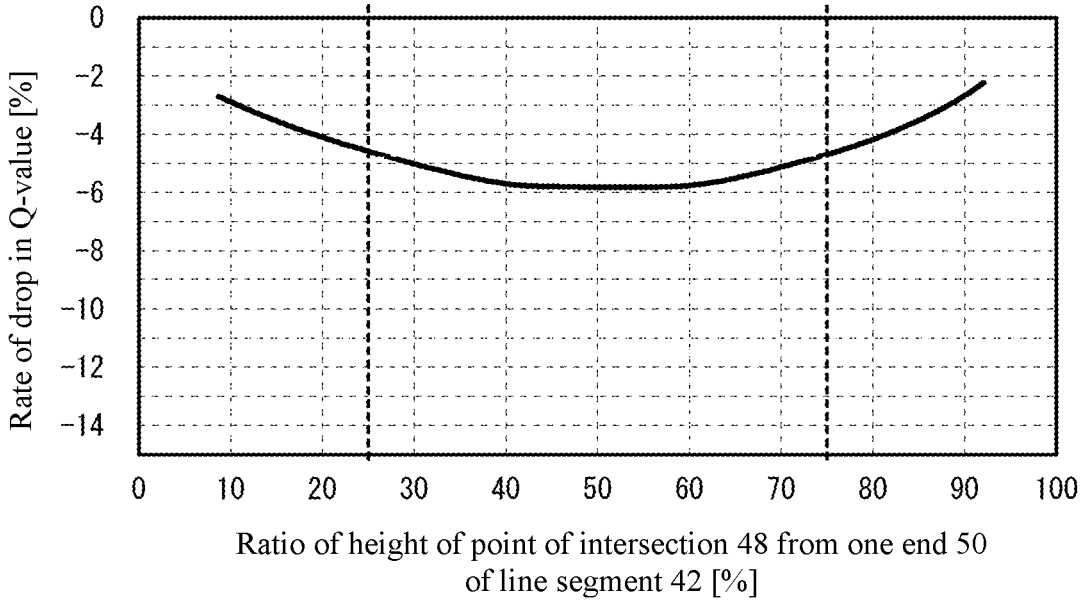
FIG. 4 is a drawing showing the measured results of Q-values.

Here, the effect of the point of intersection 48 being positioned within one-quarter of the line segment away from the one end 50 of the line segment 42, is explained based on experiments conducted by the inventors. The inventors produced multiple coil components whose winding conductors 32 had different cross-sectional shapes, or specifically multiple coil components whose point of intersection 48 was positioned differently, and measured the Q-value of each of them. The multiple coil components produced had their element body part 10 formed by an insulative body whose primary component was glass, and their coil 30 formed by a metal whose primary component was silver. FIG. 4 is a drawing showing the measured results of Q-values. In FIG. 4, the horizontal axis indicates the ratio, to the line segment 42, of the height of the point of intersection 48 from the one end 50 of the line segment 42. For example, this ratio is 0% when the point of intersection 48 is positioned at the one end 50 of the line segment 42, or 100% when it is positioned at the other end 52 opposing the side 40. In FIG. 4, the vertical axis indicates the rate of drop in Q-value based on the Q-value of the coil component exhibiting the maximum Q-value, as the reference (0%).

As shown in FIG. 4, when the point of intersection 48 is positioned within one-quarter of the line segment away from the one end 50 (25% or lower) or within one-quarter of the line segment away from the other end 52 (75% or higher), the rate of drop in Q-value is reduced to 5% or lower. The reason why the drop in Q-value was reduced this way when the point of intersection 48 was positioned within one-quarter of the line segment away from the one end 50 or the other end 52 of the line segment 42, is probably explained by the reason described below.

Figure 5A:
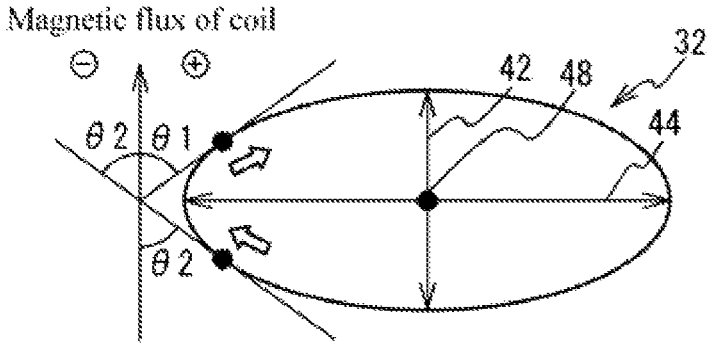
FIGS. 5A to 5C are drawings explaining why the drop in Q-value was reduced.
Figure 5B:
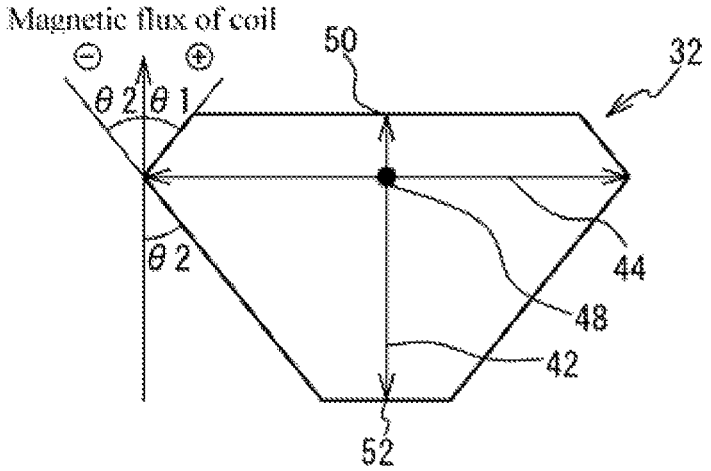
Figure 5C:
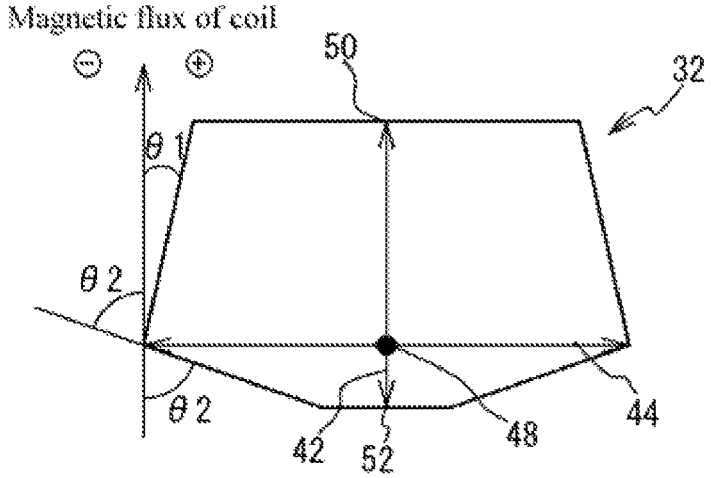

FIGS. 5A to 5C are drawings explaining why the drop in Q-value was reduced. In each of FIGS. 5A to 5C, the cross-section of one winding conductor 32 is shown by assuming that the coil axis exists on the left side of the figure. When the cross-sectional shape of the winding conductor 32 is elliptical, as shown in FIG. 5A, the point of intersection 48 is positioned at the center of the line segment 42. High-frequency electrical current tends to flow on the inner side of the winding conductor 32 (toward the center of the coil 30), so in FIG. 5A, it flows in the area in the left side of the winding conductor 32. When the winding conductor 32 has an elliptical shape, the points constituting the inner side of the winding conductor 32 include a mix of equal numbers of points having a positive (+) angle θ1, and points having a negative (−) angle θ2, relative to the magnetic flux of the coil 30 (direction of the coil axis: first direction). The magnetic flux of the coil 30 is an assembly of the magnetic fluxes of multiple winding conductors 32, but since the direction of the magnetic flux is different in the winding conductor 32 between points having a positive angle θ1 and points having a negative angle θ2 (refer to the white arrows), these magnetic fluxes cancel out one another. As a result, the magnetic flux of the coil 30 parallel with the coil axis decreases.

As shown in FIGS. 5B and 5C, there are a mix of different numbers of points having a positive angle θ1, and points having a negative angle θ2, relative to the magnetic flux of the coil 30 when the point of intersection 48 is positioned within one-quarter of the line segment away from the one end 50 or the other end 52 of the line segment 42. This reduces the drop in the magnetic flux of the coil 30 due to the magnetic fluxes at the respective points cancelling out one another. This is probably why the drop in Q-value was reduced. Similarly, it is clear according to FIG. 4 that, when the point of intersection 48 is positioned within one-sixth of the way from the one end 50, or within one-sixth of the way from the other end 52, of the line segment 42, then the rate of drop in Q-value is reduced to 4% or lower, which is more preferable. Also, when the point of intersection 48 is positioned within one-tenth of the way from the one end 50, or within one-tenth of the way from the other end 52, of the line segment 42, then the rate of drop in Q-value is reduced to 3% or lower, which is even more preferable.

Figure 6:
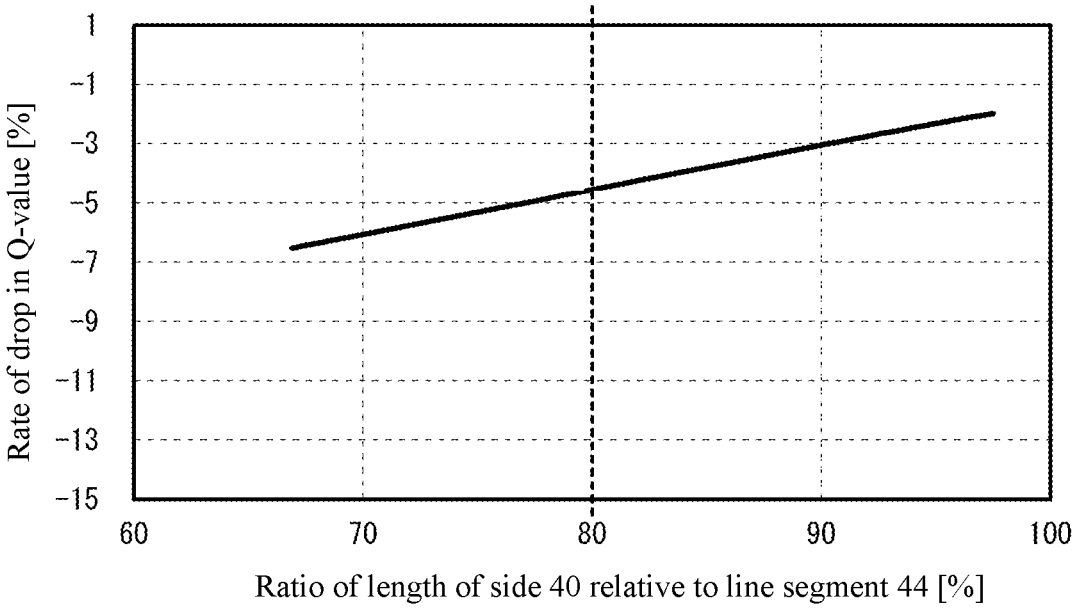
FIG. 6 is a drawing showing the measured results of Q-values.

Next, the effect of the ratio of the length C of the side 40 relative to the length A of the line segment 44 being equal to or greater than 4/5, is explained. FIG. 6 is a drawing showing, relative to a coil component whose point of intersection 48 has a height ratio in a range of 15% to 35% (i.e., coil component whose horizontal-axis value is in a range of 15% to 35%), the ratio of the length C of the side 40 relative to the length A of the line segment 44 along the horizontal axis, and the rate of drop in Q-value along the vertical axis.

As shown in FIG. 6, the rate of drop in Q-value is reduced to 5% or lower when the ratio of the length C of the side 40 relative to the length A of the line segment 44 is equal to or greater than 4/5 (equal to or greater than 80%). Similarly, it is evident from FIG. 6 that, when the ratio of the length C of the side 40 relative to the length A of the line segment 44 is equal to or greater than 6/7 (equal to or greater than 85.7%), the rate of drop in Q-value is reduced to 4% or lower, which is preferable. Also, when the ratio of the length C of the side 40 relative to the length A of the line segment 44 is equal to or greater than 9/10 (equal to or greater than 90%), the rate of drop in Q-value is reduced to 3% or less, which is more preferable.

Figure 7A:
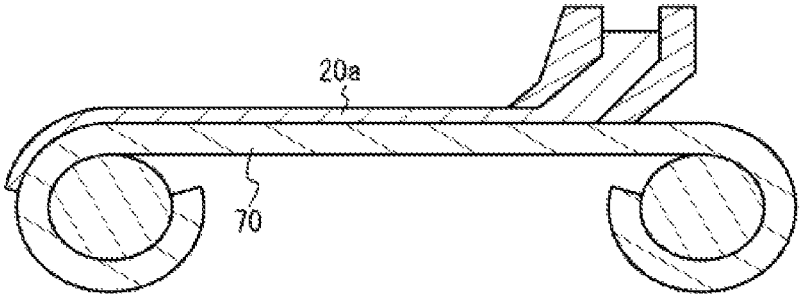
FIGS. 7A to 7E are drawings showing a method for manufacturing the coil component pertaining to the example (Part 1).

Next, the method for manufacturing the coil component 100 in the example is explained. FIGS. 7A to 8C are drawings showing the method for manufacturing the coil component in the example. It should be noted that FIG. 7E shows the cross-section of a winding conductor 32 as viewed from direction A in FIG. 7D. As shown in FIG. 7A, an insulation paste is applied on a film 70 made of polyethylene terephthalate (PET), etc., for example, using the doctor blade method, etc., for example, to form a green sheet 20*a* which is an insulation sheet. The thickness of the green sheet 20*a* is 5 μm to 60 μm, for example. For the insulation paste, an insulation material whose primary component is glass or resin, or a magnetic material such as ferrite, may be used.

Figure 7B:
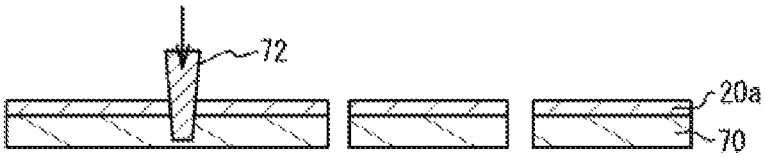
Figure 7C:
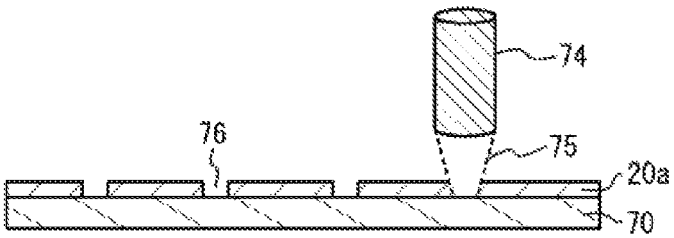

As shown in FIG. 7B, after the green sheet 20*a* has been formed on the film 70, the film 70 and green sheet 20*a* are cut using a blade 72, for example, into multiple sheets. Next, as shown in FIG. 7C, the cut multiple green sheets 20*a* are each irradiated with a laser beam 75 using a laser machine 74, for example, to form through holes 76 in the green sheets 20*a*.

Figure 7D:
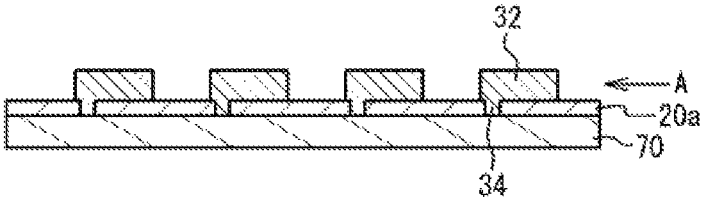
Figure 7E:
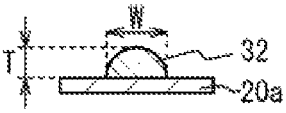

As shown in FIG. 7D, a conductive material is printed on the green sheet 20*a* surface using a printing method (such as the screen printing method), to form winding conductors 32 and through hole conductors 34 that will constitute a coil 30. Here, as shown in FIG. 7E, a conductive material, etc., is set as deemed appropriate so that the relationship between the width W and height T of the cross-sectional shape of the winding conductor 32 in the width direction meets $T/W \geq 2/3$. It should be noted that, in this stage, the winding conductors 32 and through hole conductors 34 are their respective precursors and will become winding conductors 32 and through hole conductors 34 when sintered, as described below.

Figure 8A:
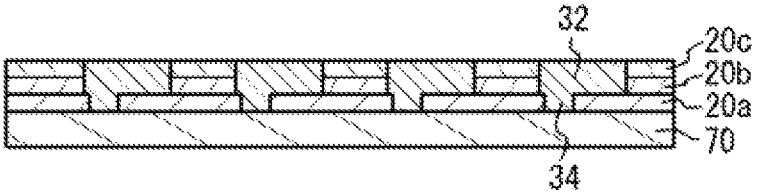
FIGS. 8A to 8C are drawings showing a method for manufacturing the coil component pertaining to the example (Part 2).

As shown in FIG. 8A, insulation paste 20*b*, 20*c* are applied using a printing method (such as the screen printing method), in a manner filling the areas around the winding conductors 32. For example, use of low-viscosity insulation pastes 20*b*, 20*c* allows the insulation pastes 20*b*, 20*c* to flow into the clearance parts from the winding conductors 32 as required in the printing process, thereby forming insulation pastes 20*b*, 20*c* covering the side faces of the winding conductors 32 while exposing the top faces of the winding conductors 32. Desirably the top face parts of the insulation pastes 20*b*, 20*c* stacked on top of each other to cover the side faces of the winding conductors 32, and the top face parts of the winding conductors 32, are the same. The insulation pastes 20*b*, 20*c* may be printed separately. By varying one or more of the grain size of insulating material, the grain size distribution of insulating material, the grain shape of insulating material, the grain fill ratio of insulating material, the kind of binder, the viscosity of binder, and the ratio of binder which are contained in each of the insulation pastes 20*b* and 20*c*, the compression behavior that manifests when the insulation pastes 20*b*, 20*c* are pressure-bonded, can be changed. The ratio of the application thickness of the insulation pastes 20*b*, 20*c* may be set in any way as desired according to the cross-sectional shape of the winding conductor 32 after pressure-bonding, as described below.

Figure 8B:
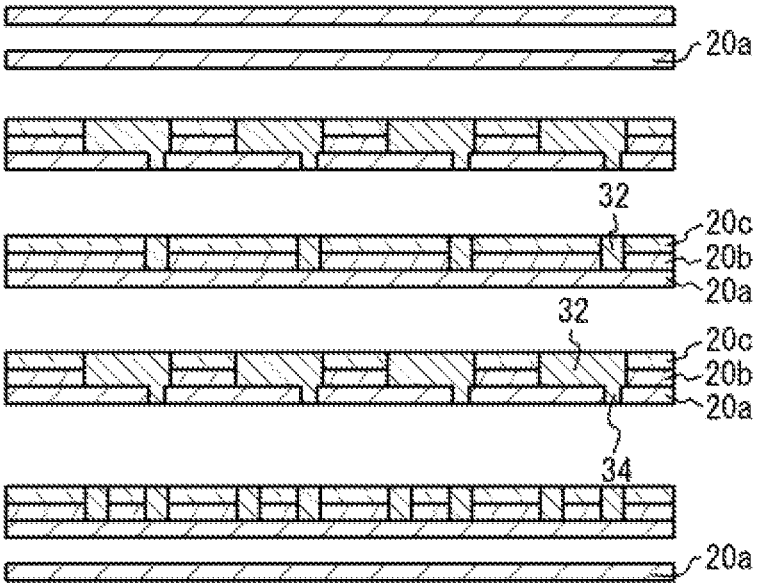

As shown in FIG. 8B, the formation of the insulation pastes 20*b*, 20*c* in a manner covering the side faces of the winding conductors 32 is followed by stacking of the multiple green sheets 20*a* in a prescribed order and pressure-bonding of the multiple green sheets 20*a* by applying pressure to them in the stacking direction.

Figure 8C:
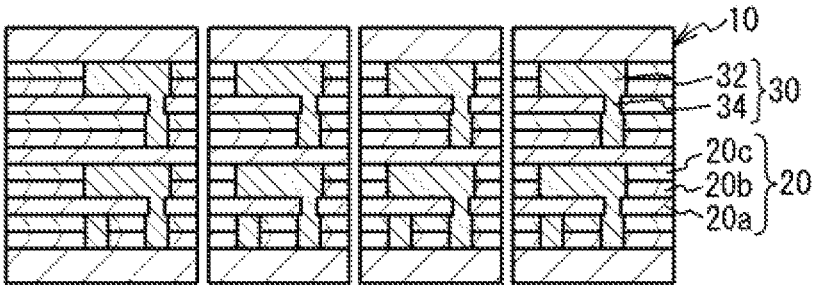

As shown in FIG. 8C, the pressure-bonded multiple green sheets 20*a* are cut to individual chips, which are then sintered at a prescribed temperature (such as approx. 700° C. to 900° C.). As a result, the multiple insulation layers 20 are stacked together to form an element body part 10 having a coil 30 formed by the winding conductors 32 and through hole conductors 34 inside. Thereafter, external electrodes 60 (refer to FIG. 1) are formed on the surface of the element body part 10 by printing a paste, plating, sputtering or other method used in the thin-film forming processes.

According to Example 1, the multiple winding conductors 32 each have, in a cross-sectional view in the width direction of the winding conductor 32, a side 40 that extends straight in the second direction crossing at right angles with the coil axis, as shown in FIGS. 3A and 3B. And, as shown in FIG. 3B, the point of intersection 48 between the line segment 42 corresponding to the longest part in the first direction corresponding to the direction of the coil axis, and the line segment 44 corresponding to the longest part in the second direction, of the winding conductor 32, is positioned within one-quarter of the line segment away from the one end 50 of the line segment 42 or, as shown in FIG. 5C, within one-quarter of the line segment away from the other end 52. This way, the Q-value can be improved as explained using FIGS. 4 and 5A to 5C.

Also, according to Example 1, the ratio (C/A) of the length C of the side 40 relative to the length A of the line segment 44 being the longest part in the second direction, of the winding conductor 32, is equal to or greater than 4/5. This way, the Q-value can be improved effectively as explained using FIG. 6.

Also, according to Example 1, winding conductors 32 and through hole conductors 34 that will constitute a coil 30 are formed on multiple green sheets 20*a*, as shown in FIG. 7D. As shown in FIG. 8A, insulation pastes 20*b*, 20*c* are applied on the multiple green sheets 20*a* in a manner covering the side faces of the winding conductors 32. Desirably the top face of these insulation pastes 20*b*, 20*c* covering the side faces of the winding conductors 32 is the same as the top faces of the winding conductors 32. And, as shown in FIG. 8B, the multiple green sheets 20*a* are stacked and pressure-bonded. By stacking and then pressure-bonding the multiple green sheets 20*a* after covering the side faces of the winding conductors 32 with the insulation pastes 20*b*, 20*c*, as described above, any shape change of the winding conductors 32 due to the stacking of the green sheets 20*a* can be reduced. Furthermore, a desired ratio can be set for the application thicknesses of the insulation pastes 20*b*, 20*c* whose compression behavior during pressure-bonding is different, which allows for control of the degree of deformation of the winding conductors 32 in the side face direction during pressure-bonding. As a result, winding conductors 32 of the shape shown in FIG. 3B or 5C can be formed, to improve the Q-value.

Figure 9A:
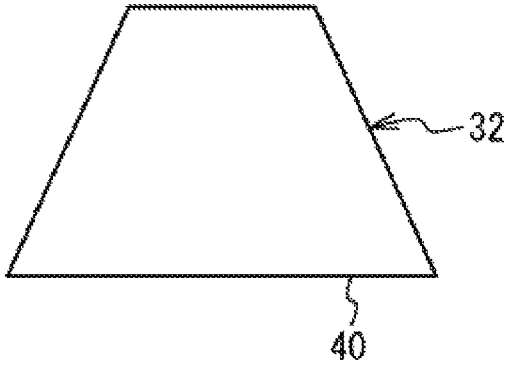
FIGS. 9A to 9C are drawings showing other examples of the cross-sectional shape of the winding conductor.
Figure 9B:
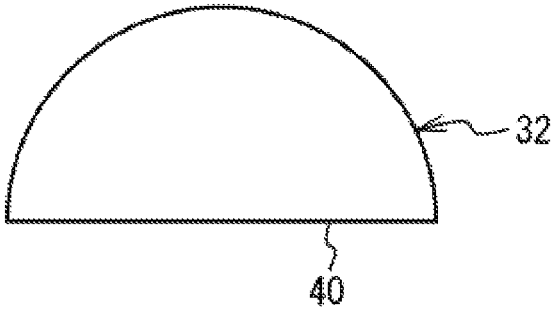
Figure 9C:
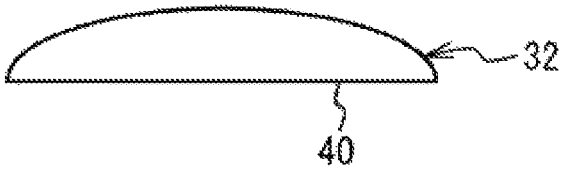

FIGS. 9A to 9C are drawings showing other examples of the cross-sectional shape of the winding conductor. The winding conductor 32 may have, in a cross-sectional view in the width direction of the winding conductor 32, a roughly trapezoidal shape having the side 40 constituting one bottom side as shown in FIG. 9A, or a roughly semi-circular shape as shown in FIG. 9B, or a roughly semi-elliptical shape as shown in FIG. 9C. It should be noted that "roughly semi-circular" and "roughly semi-elliptical" are not limited to semi-circular and semi-elliptical shapes having the side 40 constituting their diameter or long axis, but they also include those shapes not having the side 40 constituting their diameter or long axis.

Figure 10A:
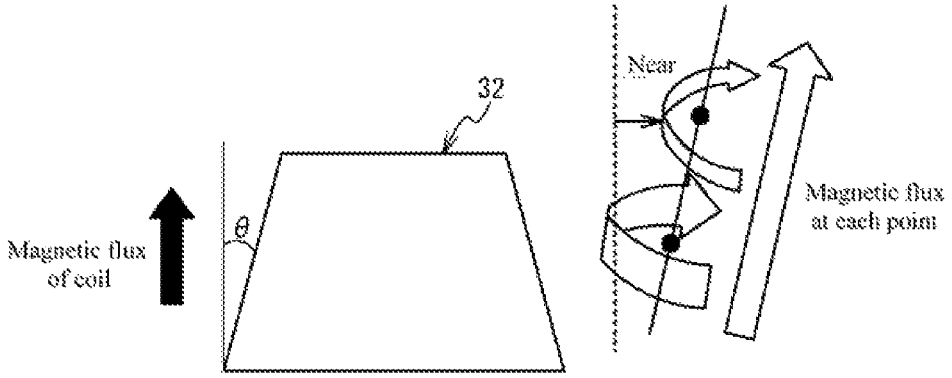
FIGS. 10A to 10C are drawings explaining the relationship between the angle of the winding conductor relative to the magnetic flux of the coil, and the Q-value of the coil.
Figure 10B:
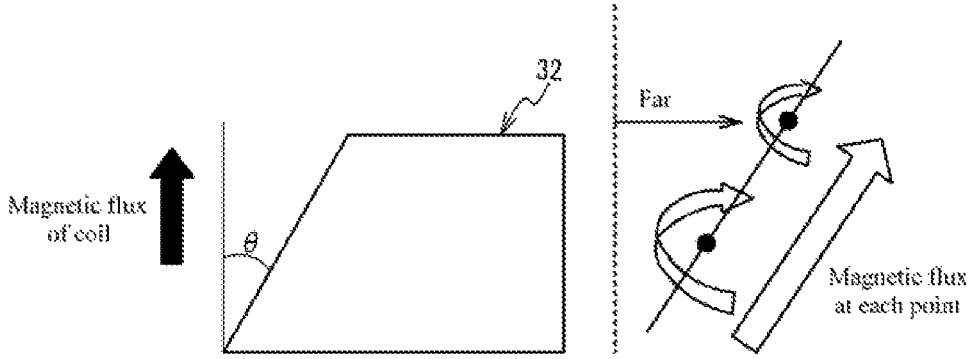
Figure 10C:
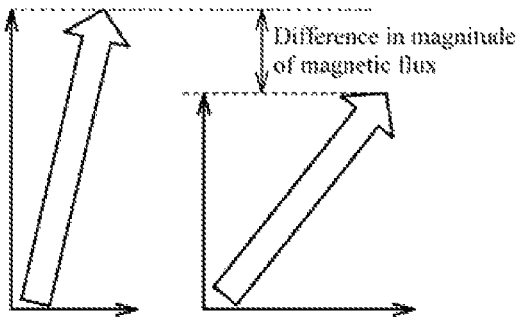

FIGS. 10A to 10C are drawings explaining the relationship between the angle of the winding conductor relative to the magnetic flux of the coil, and the Q-value of the coil. It is evident from FIG. 10A that, when the angle θ of the winding conductor 32 relative to the magnetic flux (refer to the black arrow) generating in the coil 30 is small, the magnetic flux generating at each point on the inner side of the winding conductor 32 (toward the center of the coil 30) where high-frequency electrical current tends to flow, has a small inclination relative to the magnetic flux of the coil 30. When the angle θ of the winding conductor 32 relative to the magnetic flux of the coil 30 is large, on the other hand, as shown in FIG. 10B, the magnetic flux generating at each point on the inner side of the winding conductor 32 has a large inclination relative to the magnetic flux of the coil 30. This means that, when the magnetic fluxes generating on the inner side of the winding conductor 32 when the angle θ of the winding conductor 32 is small, are compared with the magnetic fluxes generating on the inner side of the winding conductor 32 when the angle θ is large, as shown in FIG. 10C, it is revealed that the magnetic fluxes parallel with the magnetic flux of the coil 30 (coil axis) become large if the angle θ is small. In other words, the smaller the angle θ of the winding conductor 32 relative to the magnetic flux of the coil 30, the larger the magnetic flux of the coil 30 becomes. Accordingly, the angle θ of the winding conductor 32 relative to the magnetic flux of the coil 30 (coil axis) is preferably small, or preferably equal to or smaller than 45°, or more preferably equal to or smaller than 30°, or even more preferably equal to or smaller than 20°. In addition, the length B of the line segment 42 of the winding conductor 32 is preferably equal to or greater than ½ times, or more preferably equal to or greater than times 1, or even more preferably equal to or greater than 3/2 times, the length A of the line segment 44. This is because the greater the length B of the line segment 42 relative to the length A of the line segment 44, the smaller the angle θ of the winding conductor 32 can be made relative to the magnetic flux of the coil 30.

Figure 11A:
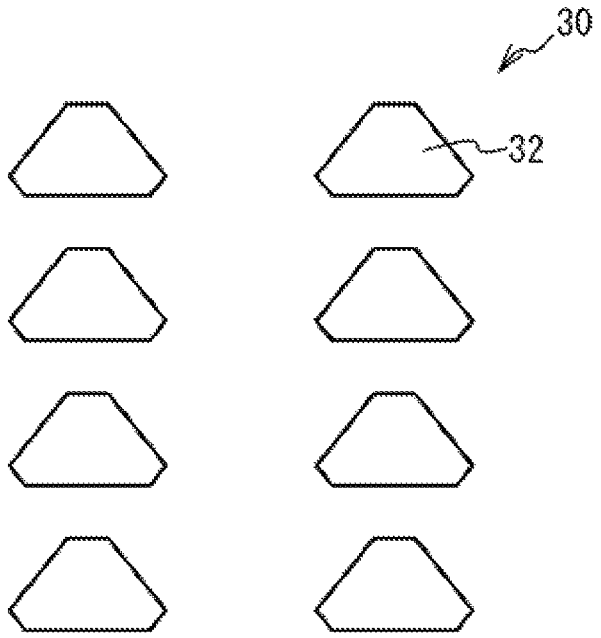
FIGS. 11A and 11B are drawings explaining the relationship between the cross-sectional shapes of the multiple winding conductors, and the Q-value of the coil.
Figure 11B:
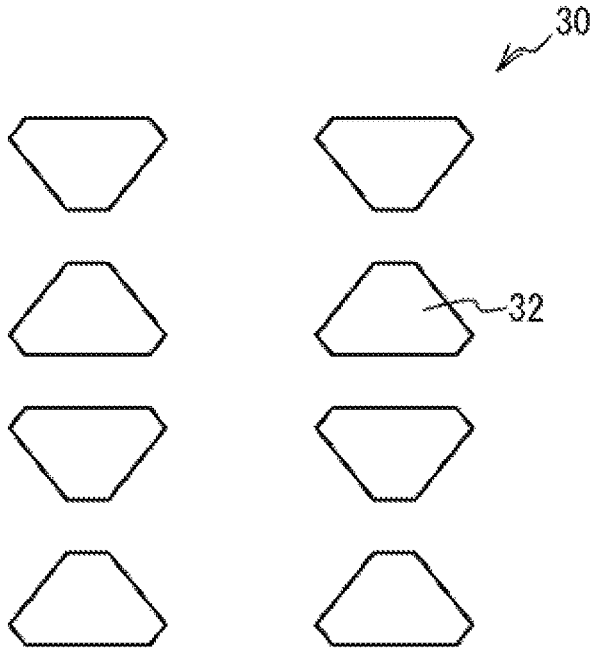

FIGS. 11A and 11B are drawings explaining the relationship between the cross-sectional shapes of the multiple winding conductors, and the Q-value of the coil. When the cross-sectional shapes of the multiple winding conductors 32 are aligned in the direction of the coil axis, as shown in FIG. 11A, the Q-value of the coil 30 becomes larger compared to when the cross-sectional shapes of some of the multiple winding conductors 32 are reversed in the direction of the coil axis, as shown in FIG. 11B. This is probably explained by the fact that, when the directions of the magnetic fluxes at the points constituting the inner side of the winding conductors 32 are aligned in the direction of the coil axis, the magnetic fluxes are directionally in agreement with one another and thus exert a mutually strengthening effect; whereas, when the directions of the magnetic fluxes at the points constituting the inner side of the winding conductors 32 are reversed in the direction of the coil axis, the magnetic fluxes are directionally not in agreement with one another and thus exert a mutually weakening effect. This means that, preferably in all of the multiple winding conductors 32, the point of intersection 48 between the line segment 42 and the line segment 44 is positioned within one-quarter of the line segment away from the one end 50 of the line segment 42. Or, preferably in all of the multiple winding conductors 32, the point of intersection 48 between the line segment 42 and the line segment 44 is positioned within one-quarter of the line segment away from the other end 52 of the line segment 42. This way, the cross-sectional shapes of the multiple winding conductors 32 can be aligned in one way relative to the direction of the coil axis. To be specific, they can be aligned to the shape where the points constituting the inner side of the winding conductor 32 include more points having a positive (+) angle θ1, as shown in FIG. 5C, or the shape where they include more points having a negative (−) angle θ2, as shown in FIG. 5B, relative to the magnetic flux of the coil (direction of the coil axis: first direction), and accordingly the Q-value of the coil can be increased. Here, when the position of the point of intersection 48 is converted to a numerical value based on the one end 50 and the other end 52 of the line segment 42 representing 0 and 100, respectively, the difference between the maximum value of the point of intersection 48, and the minimum value of the point of intersection 48, among the multiple winding conductors 32, is preferably equal to or smaller than 10, or more preferably equal to or smaller than 8, or even more preferably equal to or smaller than 5. This way, the cross-sectional shapes can be aligned within a smaller range, and therefore the Q-value of the coil can be increased further.

The foregoing described an example of the present invention in detail; it should be noted, however, that the present invention is not limited to this specific example and various modifications and changes may be added to the extent that they do not deviate from the key points of the present invention as described in "What Is Claimed Is."

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2017-151109, filed Aug. 3, 2017, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component comprising:

an element body part made of an insulative body; and a coil of spiral shape provided inside the element body part and constituted by multiple winding conductors and through hole conductors that interconnect the multiple winding conductors;

wherein the multiple winding conductors each have a cross-sectional shape such that each has, in a cross-sectional view randomly selected in a width direction of the winding conductor on a plane parallel to a coil axis of the coil, a flat side that extends in a direction substantially perpendicular to the coil axis of the coil;

a point of intersection between a first figure line drawn to represent a longest part of the winding conductor along a direction of the coil axis, and a second figure line drawn to represent a longest part along a direction substantially perpendicular to the direction of the coil axis, is positioned along the first figure line to satisfy $0\% < RL \leq 25\%$ or $75\% \leq RL < 100\%$ wherein RL denotes a ratio (%) of length between the point of intersection and one end of the first figure on the flat side to a length of the first figure line; and the second figure line is longer than a length of the flat side as well as a length of a side opposing the flat side, in the direction substantially perpendicular to the direction of the coil axis.

2. The coil component according to claim 1, wherein a ratio of the length of the flat side relative to a length of the second figure line is equal to or greater than 4/5 but less than 1.

3. The coil component according to claim 1, wherein, in all of the multiple winding conductors, the point of intersection is positioned on the first figure line within one-quarter of the first figure line away from the one end.

4. The coil component according to claim 1, wherein, in all of the multiple winding conductors, the point of intersection is positioned on the first figure line within one-quarter of away from the other end.

5. The coil component according to claim 3, wherein, when a position of the point of intersection is converted to a numeric value based on the one end and the other end of the first figure line representing 0 and 100, respectively, a difference between a maximum value of the point of intersection, and a minimum value of the point of intersection, among the multiple winding conductors, is equal to or smaller than 10.

6. The coil component according to claim 4, wherein, when a position of the point of intersection is converted to a numeric value based on the one end and the other end of the first figure line representing 0 and 100, respectively, a difference between a maximum value of the point of intersection, and a minimum value of the point of intersection, among the multiple winding conductors, is equal to or smaller than 10.

7. The coil component according to claim 1, wherein a length of the first figure line is equal to or greater than ½ times a length of the second figure line.

8. The coil component according to claim 1, wherein the multiple winding conductors each have, in the cross-sectional view, a roughly polygonal shape, roughly semi-circular shape, or roughly semi-elliptical shape.

9. A method for manufacturing the coil component of claim 1, comprising:

a step to form, in multiple insulation sheets, winding conductors and through hole conductors that will constitute a coil;

a step to apply, on the multiple insulation sheets, multiple insulation pastes that will cover side faces of the winding conductors; and a step to stack and pressure-bond together the multiple insulation sheets to which the multiple insulation pastes have been applied, wherein the multiple insulation pastes are adjusted in a manner manifesting their compression behavior to obtain the cross-sectional shapes of the winding conductors defined in claim 1 by the step of stacking and pressure-bonding.

* * * * *